United States Patent [19]

Forbes, Jr.

[11] 4,417,655

[45] Nov. 29, 1983

[54] SHIPPING AND DISPLAY CARTON

[75] Inventor: Hampton E. Forbes, Jr., Wilmington, Del.

[73] Assignee: Westvaco Corporation, New York, N.Y.

[21] Appl. No.: 408,002

[22] Filed: Aug. 13, 1982

[51] Int. Cl.[3] ..... B65D 5/52

[52] U.S. Cl. ..... 206/45.25; 206/45.29; 206/45.28

[58] Field of Search ..... 206/45.14, 45.15, 45.29, 206/45.28, 45.31, 45.33, 624, 45.19

[56] References Cited

U.S. PATENT DOCUMENTS 1,609,186 11/1926 Peruzzi ..... 206/45.29

2,038,893 4/1936 Davidson ..... 206/624

FOREIGN PATENT DOCUMENTS 940131 10/1963 United Kingdom ..... 206/45.29

*Primary Examiner*—William T. Dixson, Jr.

*Assistant Examiner*—Brenda J. Ehrhardt

[57] ABSTRACT

The carton of the present invention is formed from a single blank of material that is cut and scored to produce a construction that may be side loaded, sealed by the shipper and then converted into a display unit at the point of use. The carbon includes a manufacturers joint formed by adhering the closure flap of the carton to a detachable portion formed within the front wall of the carton. When the detachable portion of the front wall is removed, a cut out is provided to permit access to the packaged product.

2 Claims, 7 Drawing Figures

SHIPPING AND DISPLAY CARTON

BACKGROUND OF INVENTION

It is well known in the art to provide combination cartons which may be used for shipping and displaying products for sale. Such cartons may be made from either one or two blanks of material with separate or integral display risers, and may be designed for automatic loading and sealing or hand manipulation. However, most of the prior art cartons have suffered from various defects including complicated folding schemes, the inefficient use of paperboard or other construction material, and the inability to run on high speed automatic filling and sealing equipment. U.S. Pat. No. 1,609,186 is one example of a prior art shipping/display carton wherein two blanks of paperboard are used to make the final carton. Meanwhile, U.S. Pat. No. 2,330,927 shows a shipping/display carton prepared from a single blank of material which has a self locking bottom. Each of the carton styles shown in the exemplary prior art patents include the defects hereinbefore noted.

Now, however, in accordance with the present invention, a novel construction is disclosed which can be filled and sealed more than three times faster than the presently available cartons. In addition, the carton disclosed herein is resistant to pilferage and spilling upon opening. Moreover, because of the unique and efficient blank layout, it is possible to get more blanks per sheet of paperboard than heretofore possible. Accordingly, the shipper/display carton described and claimed herein gives better layout, more cartons per sheet, less waste, greater manufacturing speed, lower cost in manufacturing, filling and sealing, and greater production speed.

SUMMARY OF INVENTION

An object of the present invention is to provide a shipper/display carton of simple design which uses a minimum amount of paperboard.

A further object is to provide a shipper/display carton that may be manufactured on high speed equipment and shipped to the user in a flat collapsed condition for filling and sealing.

Another object is to provide for the user of such a carton, a construction which readily lends itself to the automatic filling and sealing equipment presently available.

An additional object is to provide a shipper/display carton having a single manufactures glue joint that is detachable to convert the carton from its shipping configuration to its display configuration.

Yet another object of the present invention lies in the provision of an efficient detachable connection for the primary manufacturers joint of the shipper/display carton which provides a clean, easy opening for the carton when it is converted from shipper to display.

These and other objects of the present invention are achieved with the use of a simple blank structure that is cut and scored to provide a closure flap, top panel, rear panel, bottom panel and front panel connected together along spaced, parallel score lines. These panels form the central portion of a blank to which there are attached in symmetrical fashion two pairs of minor flaps and a pair of side panel tuck flaps. The blank is completed with a display riser cut out incorporated in the top panel and a detachable plug portion formed in the front panel. The detachable plug portion is applied to the front panel by suitable perforated lines to permit its easy removal when the carton is transposed from shipper to display. The preferred method for forming the perforated lines is with the use of offset, 50% micro cut lines on the inner and outer surfaces of the blank which produce a delaminatable opening. However other means for producing the front wall cut out may be used where desired.

The carton blank is prepared for shipment to the user, by applying adhesive to the cut out or plug portion of the front panel, and with two folds of the blank, the closure flap is adhered to the plug portion to form the manufacturers joint for the carton. The carton is shipped to the user in this glued and collapsed condition.

Upon receipt by the user, the carton is squared, filled from the side on suitable equipment such as an Ovellette forming and filling machine, and sealed. For the latter purpose, adhesive is applied either to the minor flaps or to the side panels, and when the side panel tuck flaps are folded and tucked, the side panels become adhered to the minor flaps on the front and rear walls to close the carton. The product stored in the carton provides support for the minor flaps during the gluing step.

The filled and sealed cartons are subsequently shipped to a retailer for display at the point of sale. At the point of sale, the manufacturers joint is broken by removing the detachable plug from the front wall, and the top panel and closure flap with plug attached are positioned behind the product to elevate the riser into its display position. Upon removing the plug portion, an arcuate cut out is provided in the front panel which permits access to the packaged products.

DETAILED DESCRIPTION

Figure 1:
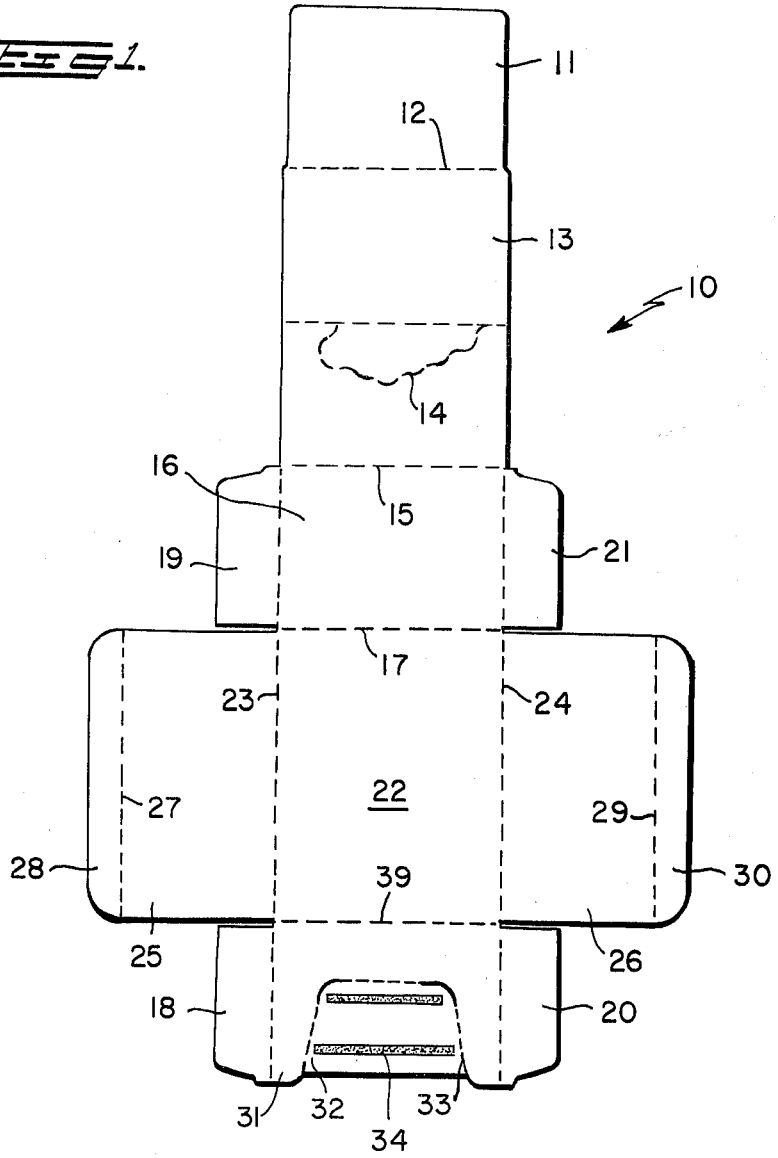
FIG. 1 is a plan view of the blank for forming the carton of the present invention.

Referring to the drawings in detail wherein corresponding reference characters denote corresponding parts throughout the several views, the numerals 10 and 40 designate the carton blank and fully formed and sealed carton respectively. The carton blank 10 is formed from a single blank of material such as paperboard or the like and is illustrated in FIG. 1 in its flat condition. The blank comprises a closure flap 11, top panel 13, rear panel 16, bottom panel 22 and front panel 31 serially connected together along score lines 12,15,17 and 39. The rear panel 16 and front panel 31 each include minor flaps 19,21 and 18,20 respectively, attached to their side edges along parallel and spaced score lines 23,24. Meanwhile, the bottom panel 22 has a pair of side panels 25,26 foldably attached at its side edges along the same score lines 23,24. Each of the side panels 25,26 include tuck flaps extensions 28,30 foldably attached thereto along score lines 27,29. In addition, the front panel 31 is cut and stored to provide a portion 32 that is removable along a curved release line 33. When removed, an arcuate cut out is formed in the front panel 31 to open the carton and provide access to the packaged product in the display condition. Moreover, the removable plug 32 also serves as the manufacturers glue joint for forming the carton. Finally, the carton blank is completed with a provision for a stand up display riser cut out 14 in top panel 13 which ultimately forms a display panel for the subject carton.

Figure 2:
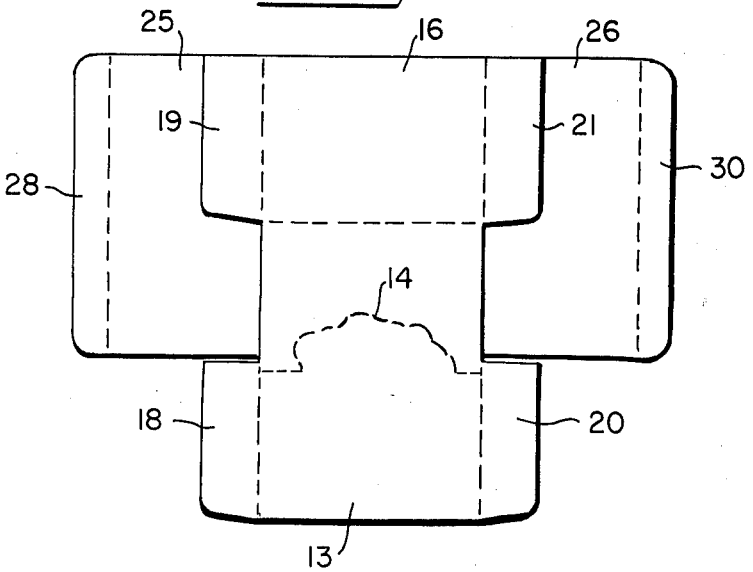
FIG. 2 shows the blank of FIG. 1 folded and glued into its flattened condition.

FIG. 2 illustrates the only forming step necessary for setting up the carton. For this purpose, the blank 10 is arranged with its inner surface up and adhesive 34 is applied to the inside of detachable portion 32 of front panel 31. The closure flap 11 is folded over initially along score line 12 and the blank is folded over again along score line 17 to place the outer surface of flap 11 adjacent to the inside of portion 32. This step serves to adhere the flap 11 to detachable portion 32 as the manufacturers joint for the carton. At this point the carton blank is left in a collapsed condition for shipment to the user.

Figure 3:
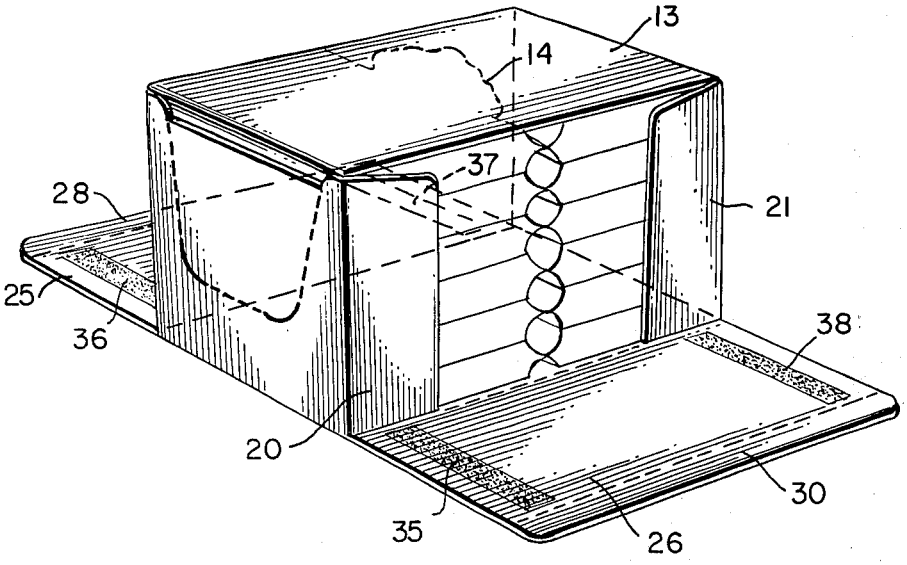
FIG. 3 is a perspective view showing the carton filled with product and ready for sealing.
Figure 4:
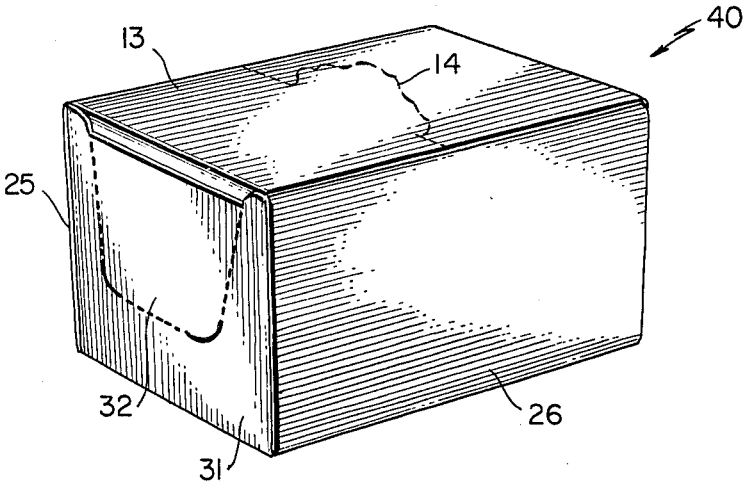
FIG. 4 is a perspective view showing a filled and sealed carton ready for shipment to the retailer; and, FIG. 5 is a perspective view showing the carton opened into its display configuration.

FIG. 3 shows the carton blank in its squared condition ready for filling and sealing. For this purpose, the carton is filled from either side with any convenient packing equipment and adhesive is applied at 35,36,37 and 38 to the edges of side panels 25,26. At this point the carton is ready for its final assembly. The minor flaps 18,19 and 20,21 are folded inwardly to rest against the product and the side panels 25,26 are folded upwardly so that the tuck flaps 28,30 fit underneath top panel 13, where the edges of panels 25,26 become adhered to the minor flaps 18,19 and 20,21. These steps produce a fully formed, filled and sealed carton 40 as shown in FIG. 4.

Figure 5:
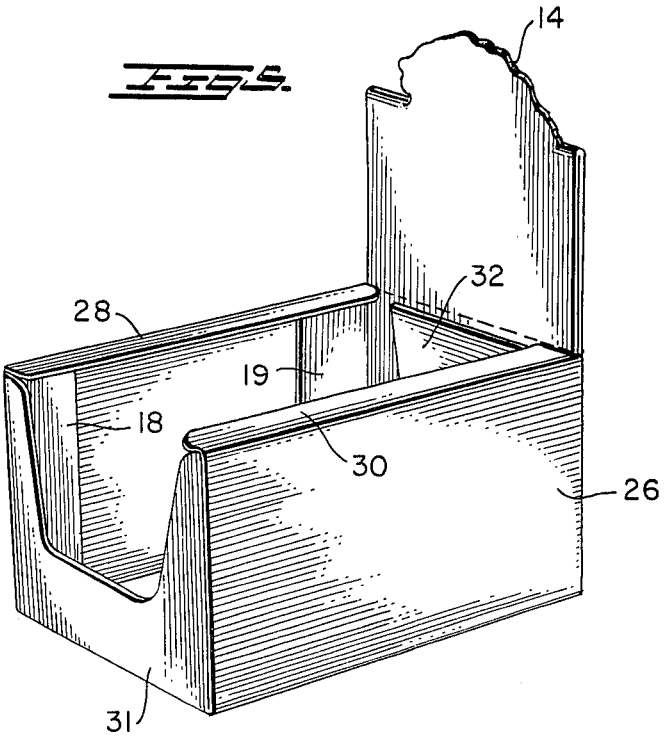

When the carton is received by the retailer it is set up for display as follows. Closure flap 11 is detached from front panel 31 in such a manner that the detachable portion 32 remains adhered to flap 11. Flap 11 is then inserted behind the product adjacent rear panel 16 by folding top panel 13 so that the display riser 14 extends upwardly above the top of the carton. These steps produce a display carton substantially as shown in FIG. 5.

Figure 1A:
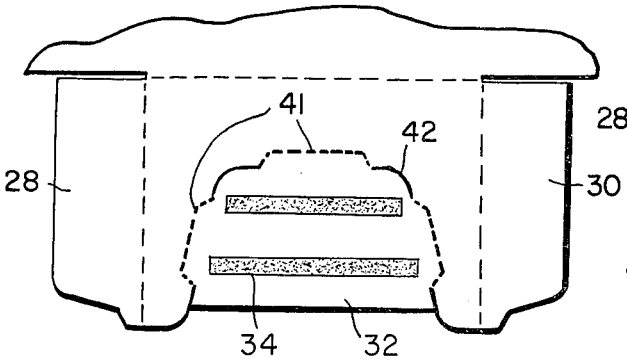
FIGS. 1(A) and 1(B) are fragmentary plan views of the front panel showing the inside and outside surfaces of the blank with the preferred lines of perforation for achieving a delaminatable opening scheme.
Figure 1B:
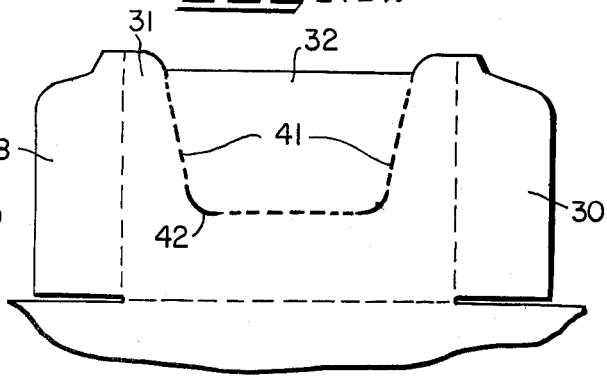

FIGS. 1(A) and 1(B) illustrate the inside and outside surfaces respectively of front panel 31 showing a preferred method for constructing the removable portion 32. In FIG. 1(A) the inside surface is shown as having a release line 33 formed by fully cut portions 42 and offset 50% micro cut portions 41. Meanwhile, in FIG. 1(B), the outside surface includes the fully cut portions 42 and coextensive 50% micro cut portions 41. When the closure flap 11 is separated from front panel 31 the paperboard material delaminates within the areas between the offset and coextensive 50% micro cut portions 41 to produce a smooth arcuate cut out in the front panel 31. The delaminatable opening performs in a manner more fully disclosed in applicant's pending U.S. patent application Ser. No. 352,598, filed Feb. 26, 1982, and in applicant's prior U.S. Pat. No. 3,951,333, entitled "Surgical Package", granted Apr. 20, 1976. Thus, when the closure flap 11 is pressed inwardly to open the carton, the paperboard delaminates or splits in the region between the offset 50% micro cut lines in the inner and outer surfaces of front panel 11 in such a manner that a smooth edge remains in front panel 31, and the delaminated paperboard in the region between the 50% micro cut remains adhered to the closure flap 11. It should be understood that while the delaminatable opening scheme is the preferred method for removing the detachable portion 32 from front panel 31, other methods may also be used. For instance a continuous perforated line of any desired shape may be used where there is no requirement for leaving a smooth edge on the cut out in front panel 11. Alternating cut and score portions may be applied to the panel to achieve the same purpose.

Accordingly, while only one embodiment has been specifically illustrated and described in connection with the present invention, it should be understood that alterations and modifications may be made therein within the scope of the appended claims.

I claim:

1. A shipper/display carton prepared from an elongated blank of foldable sheet material comprising, in order, front, bottom, rear and top panels foldably connected together, said top panel including an integral display riser section cut from a portion of the top panel which normally lies in the plane of the top panel, a front closure flap foldably attached to said top panel and tucked behind and adhered to the inside of said front panel, minor flaps foldably attached to the side edges of said front and rear panels, a pair of side closure panels including tuck flaps foldably attached to the side edges of said bottom panel and adhered to said minor flaps, a detachable cut out portion in said front panel formed by an arcuate release line that extends from an upper edge of said front panel downwardly and across said front panel and then upwardly back to the upper edge of said front panel, means adhering the front closure flap to the inside surface of said detachable cut out to form the manufacturers joint for said carton in its shipper configuration, and means for opening said carton for its display configuration wherein the detachable cut out portion of said front panel is separated from the front wall and said front closure flap with the detachable cut out attached is folded adjacent to the rear panel to open the carton and automatically elevate the display riser section of said top panel into its display condition.

2. The carton of claim 1 wherein said detachable cut out is applied to said front panel with the use of offset 50% micro cuts on the inner and outer surfaces of said front panel to produce a delaminatable opening.

* * * * *